US006669449B2

(12) United States Patent
Giacomino

(10) Patent No.: US 6,669,449 B2
(45) Date of Patent: Dec. 30, 2003

(54) PAD PLUNGER ASSEMBLY WITH ONE-PIECE LOCKING END MEMBERS

(76) Inventor: Jeff L. Giacomino, 1762 Denver Ave., Ft. Lupton, CO (US) 80621

( * ) Notice: Subject to any disclaimer, the term of this patent is extended or adjusted under 35 U.S.C. 154(b) by 0 days.

(21) Appl. No.: 10/210,947

(22) Filed: Aug. 2, 2002

(65) Prior Publication Data

US 2003/0039552 A1 Feb. 27, 2003

Related U.S. Application Data

(60) Provisional application No. 60/315,305, filed on Aug. 27, 2001.

(51) Int. Cl.[7] ..... F04B 47/12

(52) U.S. Cl. ..... 417/56; 92/172; 166/153; 403/278

(58) Field of Search ..... 417/56–59; 92/172; 166/153; 403/278

(56) References Cited

U.S. PATENT DOCUMENTS

| | | | | |
|---|---|---|---|---|
| 598,700 A | | 2/1898 | Edwards | |
| 1,108,313 A | | 8/1914 | Anderson | |
| 1,643,119 A | | 9/1927 | Hartman | |
| 2,633,808 A | | 4/1953 | Webber | 103/225 |
| 2,919,167 A | | 12/1959 | Taylor, Jr. | 309/33 |
| 2,997,964 A | | 8/1961 | Taylor, Jr. | 103/225 |
| 3,209,660 A | | 10/1965 | Taylor, Jr. | 92/180 |
| 3,372,649 A | | 3/1968 | Webber | 103/225 |
| 3,385,222 A | | 5/1968 | Gregston | 103/52 |
| 3,424,066 A | * | 1/1969 | Moore, Jr. | 92/193 |
| 5,372,488 A | | 12/1994 | Turner | 417/554 |
| 5,427,504 A | * | 6/1995 | Dinning et al. | 417/59 |
| 6,045,335 A | * | 4/2000 | Dinning | 417/59 |
| 6,275,556 B1 | * | 8/2001 | Kinney et al. | 376/232 |

* cited by examiner

*Primary Examiner*—Charles G. Freay
(74) *Attorney, Agent, or Firm*—Flanagan & Flanagan; John R. Flanagan

(57) ABSTRACT

A pad plunger assembly includes a central mandrel having externally-threaded opposite ends, collars defined about the mandrel inwardly adjacent to the opposite ends and having circumferentially spaced recesses formed in the collars, end members having inner ends with internally-threaded bores threadably removably attached to the externally-threaded opposite ends of the mandrel, and inner annular flanges attached to and extending axially from the inner ends of the end members and adapted to receive the collars such that, for locking the end members onto the mandrel, the end members are threadably screwed onto the opposite ends of the mandrel and then the flanges are crimped so as to force circumferentially displaced portions thereof into the collar recesses thereby locking the end members.

15 Claims, 1 Drawing Sheet

PAD PLUNGER ASSEMBLY WITH ONE-PIECE LOCKING END MEMBERS

This patent application claims the benefit of U.S. provisional application No. 60/315,305, filed Aug. 27, 2001.

BACKGROUND OF THE INVENTION

1. Field of the Invention

The present invention generally relates to a gas lift plunger assembly for use in a gas-producing well and, more particularly, is concerned with pad plunger assembly with one-piece locking end members.

2. Description of the Prior Art

Gas-producing wells typically employ a plunger disposed within tubing of the well and capable of traveling vertically in the tubing as the well is cycled between shut-in and opened conditions in a manner well-known to one of ordinary skill in the art. The plunger is freely movable vertically in the well tubing and is adapted to rise vertically under the force of sufficient gas pressure to drive or lift the plunger and a slug of liquid, such as oil, above it to the surface while isolating the base of the liquid slug from the gas which lifts the plunger. The plunger falls by gravity back down the tubing of the well after the slug of liquid has been delivered to the surface and the gas pressure in the well tubing has decreased due to the transmission of gas from the well tubing to a suitable storage location.

One prior art plunger assembly, called a pad plunger, includes an elongated rigid non-flexible central rod or mandrel and a pair of end members attached to the opposite ends of the mandrel. The end members of the plunger have larger diameters than the mandrel and are internally threaded to permit their removable attachment to the externally threaded opposite ends of the mandrel.

From the foregoing description, it is readily apparent that the pad plunger is made up of an assembly of various parts. It is very important to lock the end members on the plunger so that the pad plunger does not come apart while in the well. The cost of retrieving the plunger parts from the well can range from $1000 to $5000 not including lost production.

Drawbacks exist, however, with the above-described prior art plunger in the manner used to lock the end member on the mandrel. Locking subassemblies 10, such as the one shown in FIG. 1, that have been used are very labor intensive and have required numerous parts, namely, a locking ball 12 and one or more, usually three, locking rings 14 per plunger. The plunger mandrel 16 and end member 18 have to be drilled to provide a hole 20 extending through the side of the end member 18 and into the mandrel 16 so that the locking ball 12, such as ⅜ inch in diameter, can be dropped in the hole 20 and then the locking ring 14 applied about an annular recess 22 in the end member 18 so as to overlie the hole 20 and retain the ball 12 in the hole. The presence of the ball 12 in the hole 20 prevents the end member 18 from turning and unthreading from the threaded end of the mandrel 16. However, corrosion problems typically occur behind the rings. Over a short period of time the rings become loose causing premature plunger wear. Therefore, the locking rings are being welded in addition to being crimped, adding more time for labor.

Consequently, a need still exists for an innovation which will provide a solution to the aforementioned problems in the prior art without introducing any new problems in place thereof.

SUMMARY OF THE INVENTION

The present invention provides a pad plunger assembly with one-piece locking end members designed to satisfy the aforementioned need. The solution of the present invention to the aforementioned problems is to provide one-piece locking end members with features which require less labor usage and eliminate multiple parts.

Accordingly, the present invention is directed to a pad plunger assembly which comprises: (a) an elongated central mandrel having a pair of opposite ends with fastening elements thereon; (b) a pair of annular collars each attached to and extending about the mandrel inwardly adjacent to one of the opposite ends thereof, each of the collars having formed therein a plurality of recesses circumferentially spaced from one another about the collar; (c) a pair of end members each having an inner end with an interior bore and fastening elements therein and being removably fastened to one of the opposite ends of the mandrel; and (d) a pair of inner annular flanges each attached to and extending axially from the inner end of one of the end members and adapted to be received over one of the collars such that, for locking the end members onto the mandrel, the end members are fastened onto the opposite ends of the mandrel and then the annular flanges are crimped so as to force circumferentially displaced portions thereof into the recesses of the collars thereby locking the end members in place on the opposite ends of the mandrel such that the end members cannot then be unfastened from the mandrel nor become loosened over time.

More particularly, the mandrel is an elongated rigid non-flexible solid rod. The collars are integrally connected to the mandrel. Each of the inner annular flanges is integrally attached to the inner end of one of the end members. The fastening elements on the ends of the mandrel are external threads. The fastening elements in the interior bores of the end members are internal threads which threadably receive the external threads on the ends of the mandrel when the end members are fastened thereon. The mandrel, collars, end members and flanges are made of a metal.

Also, the assembly includes at least one subassembly of spring-loaded interlocking pad sections disposed about the mandrel and extending over the mandrel between the collars.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
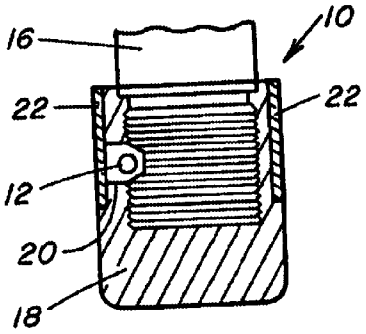
FIG. 1 (PRIOR ART)
FIG. 1 is a fragmentary partially sectional view of a subassembly used to lock an end member on a mandrel of a prior art pad plunger assembly.
Figure 2:
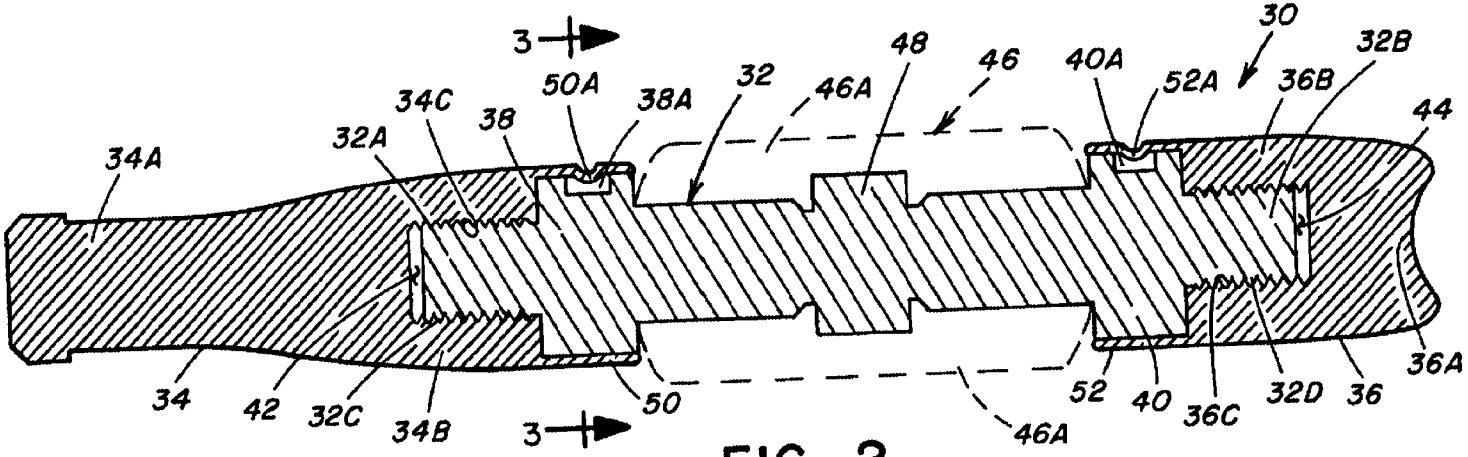
FIG. 2 is a longitudinal sectional view of a pad plunger assembly with one-piece locking end members in accordance with the present invention.
Figure 3:
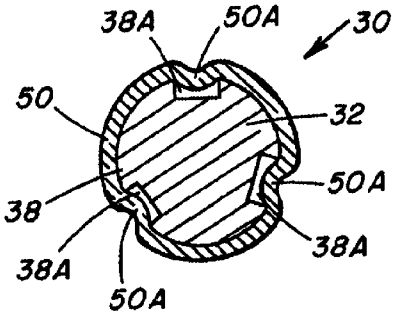
FIG. 3 is a cross-sectional view of the pad plunger assembly taken along line 3—3 of FIG. 2.

Referring to the drawings and particularly to FIGS. 2 and 3, there is illustrated a pad plunger assembly 30, generally designated 30, which incorporates the locking features of the present invention. Basically, the pad plunger assembly 30 includes an elongated central mandrel 32 and a pair of separate end members 34, 36 attached to opposite ends 32A, 32B of the mandrel 32.

The mandrel 32 of the plunger assembly 30 is in the form of an elongated rigid non-flexible solid rod. The mandrel 32 has the pair of opposite ends 32A, 32B with fastening elements in the form of external threads 32C, 32D formed thereabout. A pair of outer annular collars 38, 40 are provided on the mandrel 32, each being integrally attached to and extending about the mandrel 32 inwardly adjacent to one of the opposite ends 32A, 32B thereof.

The end members 34, 36 of the plunger assembly 30 have opposite outer and inner ends 34A, 34B and 36A, 36B. At least their inner ends 34A, 36A have larger diameters than the mandrel 32 and also have interior bores 42, 44 with respective fastening elements in the form of internal threads 34C, 36C formed therein to permit fastening, by threadable removable attachment, of the end members 32, 34 respectively to the externally threaded opposite ends 32A, 32B of the mandrel 32.

Between the opposite ends 32A, 32B of the mandrel 32, the plunger assembly 30 also includes at least one subassembly 46 of three spring-loaded interlocking pad sections 46A thereon which also overlie an annular spacer 48 being integrally formed on and extending around the mandrel 32 at an intermediate location between the opposite ends 32A, 32B thereof. In a manner well-known to one of ordinary skill in the art, the spring-loaded pad subassembly 46 can expand outwardly from and contract inwardly toward the mandrel 32 to compensate for any irregularities in the tubing thus creating a moving frictional seal with the interior surface of the well tubing. By providing a mandrel 32 having increased length, more than one subassembly 46 can be provided over and along the mandrel 32.

In accordance with the locking features of the present invention, the end members 34, 36 are one-piece components. In addition to having internally-threaded interior bores 42, 44 defined in the respective inner ends 34A, 36A thereof, the end members 34, 36 have annular inner flanges 50, 52 integrally attached to and extending axially from the respective inner ends 34A, 36A of the end members 34, 36 which are located outwardly of the bores 42, 44 and have diameter sizes adapted to be received over the annular collars 38, 40 about the mandrel 32 inwardly adjacent to the opposite ends 32A, 32B thereof. Each of the collars 38, 40 has a plurality of depressions or recesses 38A, 40A circumferentially spaced apart from one another and formed in an external surface 38C, 40C thereof.

For locking the end members 34, 36 onto the mandrel 32, each end member 34, 36 is threadably screwed onto one of the opposite externally threaded ends 32A, 32B of the mandrel 32 and then the annular inner flanges 50, 52 of the respective end members 34, 36 are crimped inwardly so as to force circumferentially displaced portions 50A, 52A of the flanges 50, 52 into the recesses 38A, 40A of the collars 38, 40. In such manner, the end members 32, 34 are locked in place on the opposite ends 32A, 32B of the mandrel 32 and cannot unthread from the mandrel 32 and become loosened over time. This arrangement also now solves the problems of corrosion and premature plunger wear.

All of the parts of the assembly 30, namely, the mandrel 32, the collars 38, 40, the end members 34, 36, the flanges 50, 52 and the pad sections 46A are made of a suitable metal, such as steel.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A pad plunger assembly, comprising:

(a) an elongated central mandrel having a pair of opposite ends having fastening elements thereon;

(b) a pair of annular collars each attached to and extending about said mandrel inwardly adjacent to one of said opposite ends thereof, each of said collars having formed therein a plurality of recesses circumferentially spaced from one another about said collar;

(c) a pair of end members each having an inner end with an interior bore and fastening elements therein and being removably fastened to one of said opposite ends of said mandrel; and (d) a pair of inner annular flanges each attached to and extending axially from said inner end of one of said end members and adapted to be received over one of said collars such that, for locking said end members onto said mandrel, said end members are fastened onto said opposite ends of said mandrel and then said annular flanges are crimped so as to force circumferentially displaced portions thereof into said recesses of said collars thereby locking said end members in place on said opposite ends of said mandrel such that said end members cannot then be unfastened from said mandrel nor become loosened over time.

2. The assembly of claim 1 wherein said mandrel is an elongated rigid non-flexible solid rod.

3. The assembly of claim 1 wherein said collars are integrally connected to said mandrel.

4. The assembly of claim 1 wherein said fastening elements on said ends of said mandrel are external threads.

5. The assembly of claim 4 wherein said fastening elements in said interior bores of said end members are internal threads which threadably receive said external threads on said ends of said mandrel when said end members are fastened thereon.

6. The assembly of claim 1 wherein each of said inner annular flanges is integrally attached to said inner end of one of said end members.

7. The assembly of claim 1 wherein said mandrel, collars, end members and flanges are made of a metal.

8. A pad plunger assembly, comprising:

(a) an elongated central mandrel having a pair of externally-threaded opposite ends;

(b) a pair of annular collars each attached to and extending about said mandrel inwardly adjacent to one of said opposite ends thereof, each of said collars having formed therein a plurality of recesses circumferentially spaced from one another about said collar;

(c) at least one subassembly of spring-loaded interlocking pad sections disposed about said mandrel and extending over said mandrel between said collars;

(d) a pair of end members each having an inner end with an internally-threaded bore and threadably removably attached to one of said externally-threaded opposite ends of said mandrel; and (e) a pair of inner annular flanges each attached to and extending axially from said inner end of one of said end members and adapted to be received over one of said collar such that, for locking said end members onto said mandrel, said end members are threadably screwed onto said opposite ends of said mandrel and then said annular flanges are crimped so as to force circumferentially displaced portions thereof into said recesses of said collars thereby locking said end members in place on said opposite ends of said mandrel such that said end members cannot then be unthreaded from said mandrel nor become loosened over time.

9. The assembly of claim 7 wherein said mandrel is an elongated rigid non-flexible solid rod.

10. The assembly of claim 7 wherein said collars are integrally connected to said mandrel.

11. The assembly of claim 7 wherein said end members have larger diameters than said mandrel.

12. The assembly of claim 7 wherein each of said inner annular flanges is integrally attached to said inner end of one of said end members.

13. The assembly of claim 7 wherein said mandrel, collars, end members, flanges and pad sections are made of a metal.

14. A pad plunger assembly, comprising:

(a) an elongated rigid non-flexible central mandrel having a pair of externally-threaded opposite ends;

(b) a pair of outer annular collars each integrally attached and extending about said mandrel inwardly adjacent to one of said opposite ends thereof;

(b) a pair of end members having larger diameters than said mandrel, opposite outer and inner ends, bores formed in said inner ends, and internal threads in said bores permitting threadable removable attachment of said end members to said externally threaded opposite ends of said mandrel;

(c) at least one subassembly of spring-loaded interlocking pad sections disposed about said mandrel and extending over said mandrel between said outer collars; and (d) a pair of annular inner flanges each attached to and extending axially from one of said inner ends of said end members and having a diameter size adapted to be received over one of said outer collars on said mandrel, each of said outer collars having formed therein a plurality of recesses being circumferentially spaced apart from one another such that, for locking said end members onto said mandrel, each of said end members is threadably screwed onto one of said opposite externally threaded ends of said mandrel and then said inner flanges are crimped so as to force circumferentially displaced portions of said flanges into said recesses of said collars thereby locking said end members in place on said opposite ends of said mandrel such that said end members cannot then be unthreaded from said mandrel nor become loosened over time.

15. The assembly of claim 14 wherein said mandrel, outer collars, end members, inner flanges and pad sections are made of a metal.

* * * * *